US005802673A

United States Patent [19]

Nemeth

[11] Patent Number: 5,802,673

[45] Date of Patent: Sep. 8, 1998

[54] CRANK HANDLE FOR ACTUATING A WINDOW PANE

[75] Inventor: Joe Nemeth, Laval, Canada

[73] Assignee: Dero Enterprises, Inc., Montreal-North, Canada

[21] Appl. No.: 858,840

[22] Filed: May 19, 1997

[51] Int. Cl.[6] ..... A47B 95/02; B25G 1/04

[52] U.S. Cl. ..... 16/115; 74/548; 74/545; 403/362

[58] Field of Search ..... 16/115, 121, DIG. 40, 16/DIG. 41; 403/362, 378; 74/528, 543–548

[56] References Cited

U.S. PATENT DOCUMENTS

| | | | |
|---|---|---|---|
| 1,220,648 | 3/1917 | Leader | 74/548 |
| 2,305,099 | 12/1942 | Morris | 74/548 |
| 2,535,382 | 12/1950 | Bachli | 74/548 |
| 2,607,616 | 8/1952 | Davidson | 74/548 |
| 3,030,131 | 4/1962 | Scherry | 74/548 |
| 4,529,332 | 7/1985 | Glabiszewski | 403/362 |
| 5,282,395 | 2/1994 | LaPointe et al. | 74/548 |
| 5,410,778 | 5/1995 | Langevin | 16/115 |

*Primary Examiner*—Chuck Mah
*Attorney, Agent, or Firm*—Joseph W. Molasky & Associates

[57] ABSTRACT

The crank handle of a window sill used for actuating a window pane has a hollow end in which is received an insert allowing the handle to engage various sizes of crank shafts. The insert is formed of a malleable material so that it can be deformed to fit the diameter of a crank shaft to thereby securely engage the crank shaft and enable its rotation by the handle.

7 Claims, 3 Drawing Sheets

CRANK HANDLE FOR ACTUATING A WINDOW PANE

FIELD OF THE INVENTION

The present invention relates to a crank handle for engaging a crank shaft mounted to a window sill and operable to actuate a moveable window pane.

BACKGROUND OF THE INVENTION

Various types of mechanisms for opening windows exist. One type which consists of a crank shaft mounted to a window sill and operable by means of a handle may be found described in U.S. Pat. No. 5,410,778 issued May 2, 1995 to Langevin. There are many crank shafts available on the market, varying in diameters and in gripping arrangements with the hollow end of a crank shaft. Therefore, various configurations of handles are required to suit these different types of crank shafts.

OBJECTS AND STATEMENT OF THE INVENTION

It is an object of the present invention to provide an improved crank handle arrangement which will avoid the above described problems of dealing with a variety of handle constructions for different crank shafts.

It is also an object of the present invention to provide a universal crank handle that will fit all presently available crank shafts on window sills.

This is achieved by providing, in the hollow end of a crank handle, an insert which is deformable. The insert has a V-shaped configuration consisting of a web and of a pair of opposite sides, the sides having convex outer faces adapted to contact the inner wall of the hollow end of the handle and inner faces adapted to engage the crank shaft. Forcing means extend through the hollow end with an extremity thereof extending inside the hollow end and contacting the web of the insert whereby pressure exerted by the forcing means causes movement of the insert towards the crank shaft with the convex faces thereof contacting the inner wall of the hollow end and with the inner faces thereof cooperating with crank engaging means on the inner wall of the hollow end allowing the shaft to be tightly engaged by the insert so as to enable rotation of the shaft by the handle.

In one form of the invention, the crank engaging means consist of longitudinal ribs along the inner wall of the hollow end.

In another form of the invention, the inner faces of the insert consist of stepped surfaces that engage ribs on the outer wall of the crank shaft.

Preferably, the insert is made of malleable metallic material.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

DESCRIPTION OF PREFERRED EMBODIMENTS

Figure 1:
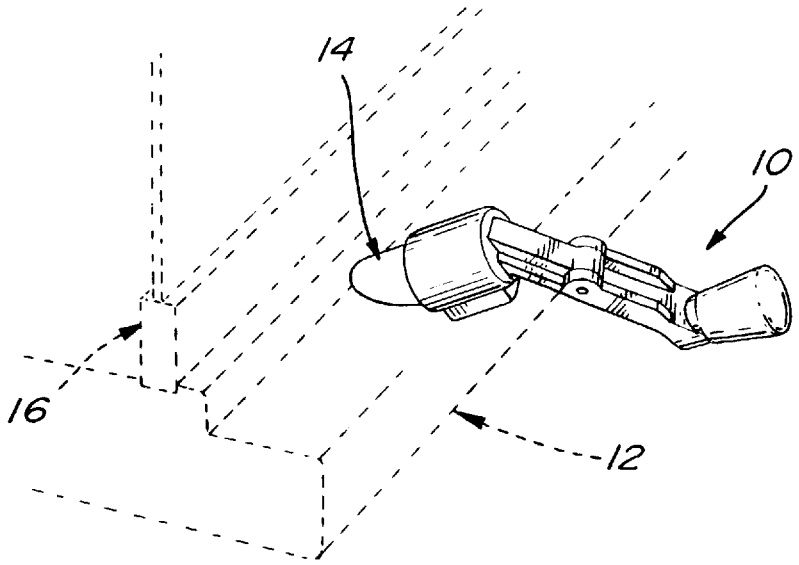
FIG. 1 is a perspective view of a crank handle made in accordance with the present invention shown mounted to a window sill (in dotted lines)

Referring to FIG. 1, there is shown a crank handle, generally denoted 10, mounted to a window sill 12 from which extends a crank housing 14 that includes components (not shown) for opening and closing a window pane 16.

Figure 2:
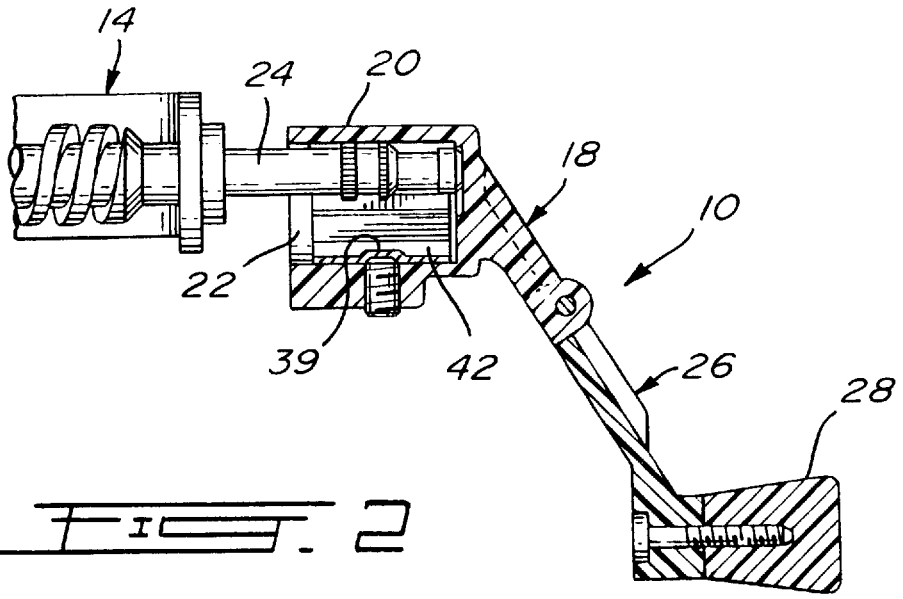
FIG. 2 is a longitudinal cross-sectional view of the handle, insert crank shaft.
Figure 3:
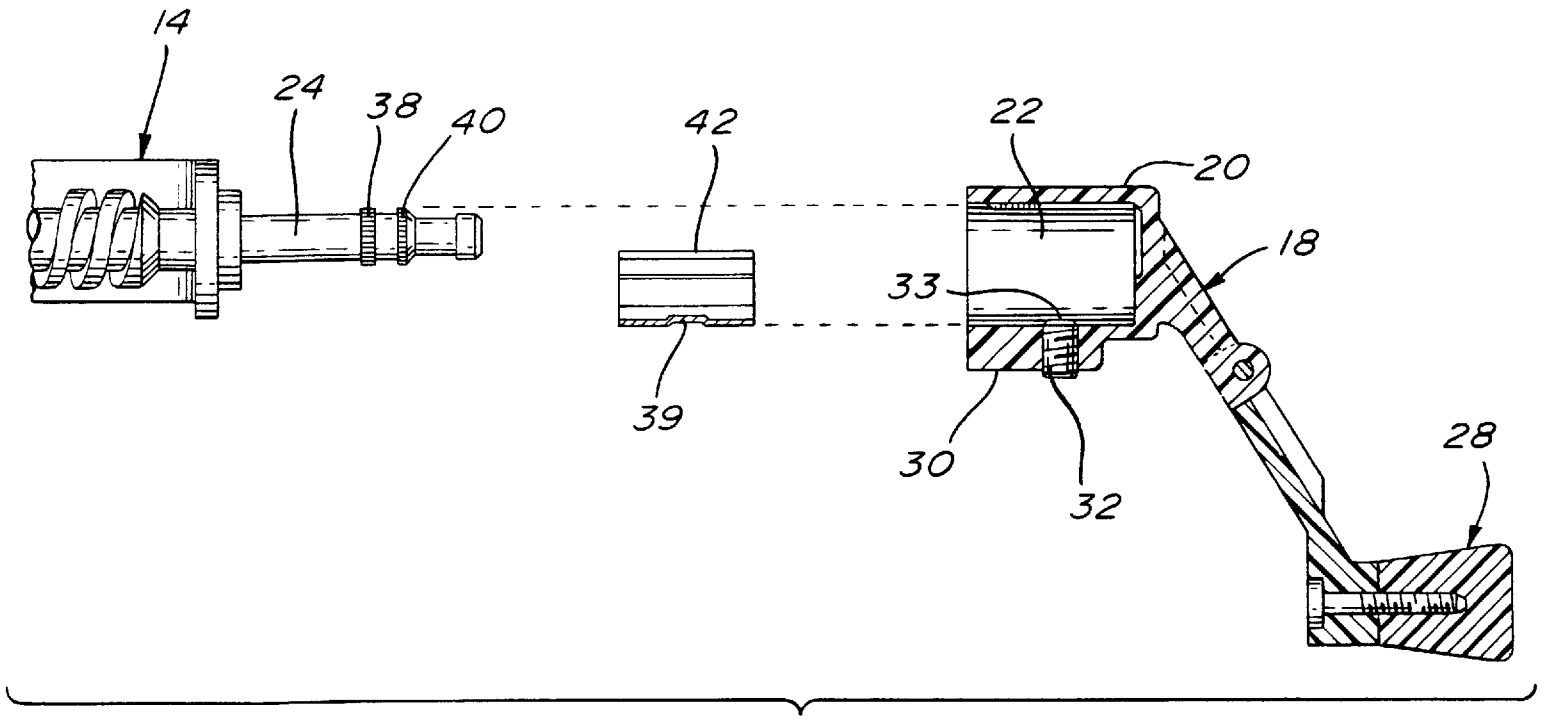
FIG. 3 is an exploded view showing the components shown in FIG. 2.

Referring to FIGS. 2 and 3, the handle 10 comprises a first part 18 having, at one end thereof, a hollow 20 having an inner wall 22 and defining a cavity in which is received the crank shaft 24, one of the components of the crank assembly. In the embodiment illustrated, the handle comprises a second part 26 which has a finger gripping rotatable knob 28 which is grasped by a user for opening and closing the window pane. The second member 26 is hingedly mounted relative to the first part 18 as described in the above mentioned U.S. patent; however, this particular construction does not form part of the present invention.

Figures 4, 5, 6:
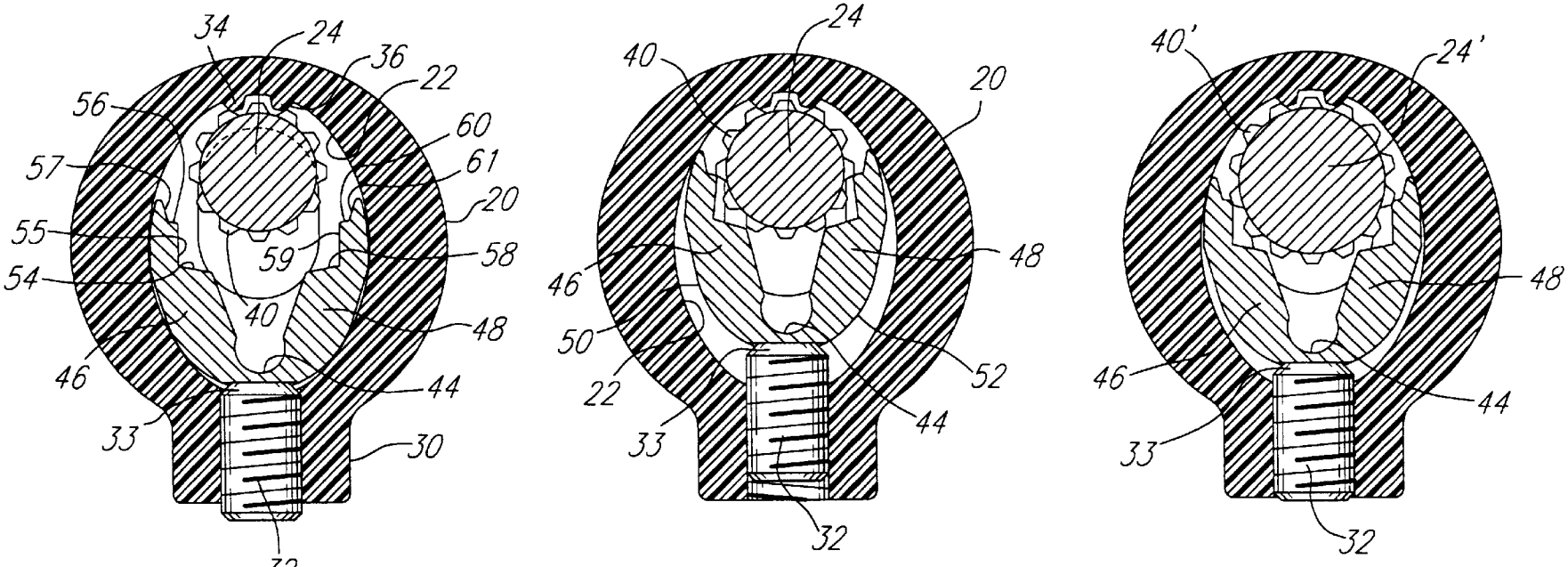
FIG. 4 and 5 are enlarged sectional views showing the relation between the insert and the crank shaft prior and after engagement with the crank shaft.
FIG. 6 is an enlarged sectional view, similar to that of FIG. 5, showing the engagement of a crank shaft having a different diameter.

As illustrated in FIG. 4, the inner wall 22 has an oval configuration. The outer wall of the hollow end 20 of the handle has a lower extension 30 displaying a threaded opening through which extends a screw 32. The inner wall 22 further includes at least two longitudinal ribs 34 and 36 projecting lengthwise thereof. Most crank shafts available on the market include one or more annular rib surfaces 38 and 40 to provide a frictional contact between the crank shaft and the handle.

The present invention is particularly concerned with a provision of an insert 42 which enables the handle to be universal in that it may fit on various sizes and dimensions of crank shafts.

The insert 42 has a V-shaped configuration, consisting essentially of a web portion 44 and of two opposite side portions 46 and 48. The insert is made of a malleable deformable material so that the two side portions 46 and 48 may move outwardly relative to the relatively thin web portion 44 of the insert. A metallic malleable material is preferred.

As can be also seen in FIG. 5, the outer surfaces 50 and 52 of the side portions 46 and 48, respectively, of the insert are somewhat convex, facing the oval shaped inner wall 22 of the hollow end.

The inner faces of the side portion 46 and 48 include a series of stepped surfaces 54, 56 and 58, 60, the function of which will be described hereinbelow.

Referring to FIGS. 4 and 5, the operation of the novel combination of a handle and insert of the present invention will now be described. The insert 42 is placed within the hollow end 20 of the handle. To secure the handle to the crank shaft 24, screw 32 is rotated by an appropriate tool (i.e. screwdriver), end 33 contacting the web 44 and forcing the insert 42 to move towards the crank shaft 24. The stepped surfaces 54, 56, 58 and 60 of the insert, either in tandem or in total combination, engage the rib surfaces 38 and 40 of the crank shaft. Continuous rotation of the screw 32 causes the projections 34 and 36 on the inner wall 22 to also be engaged by the rib surfaces 38 and 40 of the crank shaft. The screw 32 is then forcibly tightened so as to provide a secure engagement between the insert and the crank shaft. The web portion 44 may include a recess 39 shaped to receive the inner end 33 of the screw 32.

As the screw is moved inwardly onto the web portion of the insert, the convex outer surfaces of the insert slide along the oval shaped inner wall of the hollow until the stepped surfaces engages the rib surfaces of the crank shaft. The flexible deformable of the side portions 46 and 48 is achieved by the provision of a thin web portion 44 connecting the two side portions. Therefore, the material selected for the insert should be malleable so as to allow this flexing while avoiding the breaking of the insert at the web.

One advantage of the present invention is that the crank handle is universal. Referring to FIG. 6, a crank shaft 24' is illustrated having a diameter greater than that of the crank shaft 24 illustrated in FIGS. 1–5. Here again, the stepped surfaces of the insert engage the rib surfaces of the crank shaft to again provide a secure engagement between the insert and the crank shaft.

Although the invention has been described above with respect with one specific form, it will be evident to a person skilled in the art that it may be modified and refined in various ways. It is therefore wished to have it understood that the present invention should not be limited in scope, except by the terms of the following claims.

I claim:

1. In combination, a crank handle having a hollow end for engaging a crank shaft mounted to a window sill, the handle operable to actuate a moveable window pane, said hollow end of said handle defining an inner wall having an oval configuration and displaying thereon crank engaging means; a deformable insert adapted to be received in said hollow end, said insert defining a V-shaped configuration consisting of a web and a pair of opposite sides, said sides having convex outer faces adapted to contact the inner wall of said hollow end and inner faces adapted to engage said crank shaft; and forcing means extending through said hollow end and including an inner end extending in said hollow end to contact said web of said insert whereby pressure exerted by said forcing means on said web causes said convex faces of said insert to slide along said inner wall of said hollow end and said inner faces of said insert to cooperate with said crank engaging means to engage said crank shaft and to enable rotation of said crank shaft by said handle.

2. A combination as defined in claim 1, wherein said crank engaging means on said inner wall of said hollow end of said handle consist of a series of projection means thereon.

3. A combination as defined in claim 2, wherein said projection means consist of longitudinal ribs extending lengthwise on said inner wall.

4. A combination as defined in claim 1, wherein said inner faces of said insert consist of stepped surfaces adapted to engage a rib surface on the crank shaft.

5. A combination as defined in claim 1, wherein said forcing means consist of a screw having an outer end outside said hollow end whereby said screw may be operated to force the inner end thereof to contact said web of said insert.

6. A combination as defined in claim 5, wherein said web has a recess corresponding in shape to said inner end of said forcing means so as to receive said inner end therein.

7. A combination as defined in claim 1, wherein said insert is formed of malleable metallic material.

* * * * *